US009114649B2

(12) United States Patent
Nakamura

(10) Patent No.: US 9,114,649 B2
(45) Date of Patent: Aug. 25, 2015

(54) INKJET RECORDING APPARATUS

(71) Applicant: SEIKO EPSON CORPORATION, Tokyo (JP)

(72) Inventor: Tomonori Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/011,894

(22) Filed: Aug. 28, 2013

(65) Prior Publication Data

US 2014/0063092 A1 Mar. 6, 2014

(30) Foreign Application Priority Data

Aug. 31, 2012 (JP) ..... 2012-191457

(51) Int. Cl.
*B41J 25/308* (2006.01)
*B41J 29/38* (2006.01)

(52) U.S. Cl.
CPC ..... *B41J 29/38* (2013.01); *B41J 25/308* (2013.01); *B41J 25/3082* (2013.01); *B41J 25/3088* (2013.01)

(58) Field of Classification Search
CPC ... B41J 25/308; B41J 25/3082; B41J 25/3088
See application file for complete search history.

(56) References Cited

U.S. PATENT DOCUMENTS

2004/0047665 A1 3/2004 De Vore et al.
2012/0019577 A1 * 1/2012 Izawa et al. ..... 347/8

FOREIGN PATENT DOCUMENTS

EP 0891870 A2 1/1999
JP 2005-225041 A 8/2005

OTHER PUBLICATIONS

The extended European Search Report for European Application No. 13182430.2 mailed Nov. 20, 2013.

* cited by examiner

*Primary Examiner* — Julian Huffman
(74) *Attorney, Agent, or Firm* — Global IP Counselors, LLP

(57) ABSTRACT

To provide an inkjet recording apparatus in a simple configuration that can accurately adjust a gap between a nozzle surface of an inkjet head and a recording medium placed on a feed route with simple operations, it is provided with a printing section having an inkjet head and performing printing on a recording medium, an apparatus main body having a pair of side frames that supports the printing section so as to stand the inkjet head face to face with the recording medium and a medium feed mechanism that feeds the recording medium along a feed route, and a gap adjustment section moving the printing section in parallel with respect to the pair of side frames in a separate direction and adjusting a gap between the nozzle surface of the inkjet head and the recording medium placed on the feed route.

8 Claims, 4 Drawing Sheets

INKJET RECORDING APPARATUS

CROSS-REFERENCE TO RELATED APPLICATIONS

This application claims priority to Japanese Patent Application No. 2012-191457 filed on Aug. 31, 2012. The entire disclosure of Japanese Patent Application No. 2012-191457 is hereby incorporated herein by reference.

BACKGROUND

1. Technical Field

The present invention relates to an inkjet recording apparatus having a gap adjustment section that adjusts so-called paper gap.

2. Background Technology

As the inkjet recording apparatuses having this kind of gap adjustment section, it is well known that an image recording apparatus has a unit lifting mechanism that adjusts a gap between a conveyance unit and a recording head by lifting the conveyance unit of a recording medium (see Patent Document 1). This image recording apparatus has a printer main body that performs recording an image to a large-sized recording medium such as a fabric, a resin film, and the like, and a support base that supports the printer main body. The support base has vertical frames, which are arranged on the left and right, and unit support members, which are arranged on the left and right, provided in an internal space of the vertical frames. Also, a pair of the unit lifting mechanisms that lifts the conveyance unit is provided between each vertical frame and each unit support member. The respective unit lifting mechanisms have an operating handle provided in the vertical frame, a pair of lead thread mechanisms that lift the unit support members at two locations before and after (two locations in a feeding direction of a recording medium), and a power transmission device that operates the pair of the lead thread mechanisms. The pair of the lead thread mechanisms has the first rotary shaft and the second rotary shaft forming a male screw respectively, and the respective male screws of the first rotary shaft and the second rotary shaft screw together with a female screw provided in the unit support members. Also, the power transmission device has a gear train that transmits a rotation power of the operating handle to the first rotary shaft and a connecting belt that engages with the first rotary shaft and the second rotary shaft so that they are rotated. In the respective unit lifting mechanisms, when the operating handle rotates and operates, the respective unit support members are lifted through the power transmission mechanism and the pair of the lead thread mechanism. That is, in the main scanning direction of the recording head, the conveyance unit performs height adjustment in the left half by one of the unit lifting mechanisms, and performs height adjustment in the right half by the other unit lifting mechanism. Because of this, a gap between the conveyance unit and the recording head is adjusted in response to the thickness of the recording medium that is introduced.

Japanese Laid-open Patent Publication No. 2005-225041 (Patent Document 1) is an example of the related art.

SUMMARY

Problems to be Solved by the Invention

In this kind of the conventional image recording apparatus (inkjet recording apparatus), with respect to the recording head (printer main body), there was a configuration that the height adjustment was performed in each left and right half of the conveyance unit so that when a span of the adjustment range was large and the adjustment was performed separately, this became in the state that the male screw and the female screw of the lead thread mechanisms were reciprocally tilted. Thus, it was required to reciprocally or simultaneously adjust the pair of unit lifting mechanisms little by little so that it had a problem that the adjustment operation became complicated. Further, an output terminal of the height adjustment was the lead thread so that it had a problem that it was impossible to perform a fine adjustment in micron order and the printing (recording) quality cannot be improved. In addition, to lift the conveyance unit which is a heavy item, it was required to have a configuration that the support base had two machine stands (stands) that were the unit support member, which directly supports the conveyance unit, and the vertical frame, which indirectly supports the conveyance unit through the unit support member. Therefore, it had a problem that the size of the support base became large and it became complicated.

An advantage of the invention is to provide an inkjet recording apparatus in a simple configuration that can accurately adjust a gap between a nozzle surface of an inkjet head and a recording medium placed on a feed route with simple operations.

Means Used to Solve the Above-Mentioned Problems

An inkjet recording apparatus of the invention includes a printing section having an inkjet head and performing printing on a recording medium; an apparatus main body having an arrangement section that has an arrangement surface in which the recording medium is placed, and a support section that supports the printing section so as to stand the inkjet head face to face with the recording medium; and a gap adjustment section adjusting a gap between a nozzle surface of the inkjet head and the arrangement surface by moving the printing section in parallel with respect to the arrangement surface in a separate direction; wherein the gap adjustment section has a first adjustment section and a second adjustment section that are placed across the arrangement section, an input section that operates the first adjustment section, and an interlock section that interlocks the first adjustment section and the second adjustment section.

In this configuration, a gap adjustment between the nozzle surface and the arrangement surface is performed by the gap adjustment section in a way that the printing section moves in parallel with respect to the apparatus main body in the separate direction. Thus, both structures that support the printing section and the arrangement section can be used as the support section so that the structure can be a compact and simple configuration. Further, the printing section is lighter compare to the arrangement section so that the structure of the gap adjustment section can be simplified and the gap adjustment can be performed with high accuracy by simple operations. Also, the power from the input section can be simultaneously transmitted to the first adjustment section and the second adjustment section by the interlock section so that the printing section can be simultaneously moved in the separate direction. Because of this, it is not required to operate the first adjustment section and the second adjustment section separately. Therefore, the operation for the gap adjustment can be simplified and the gap adjustment can be stabilized. By the way, the separate direction means in a direction that the arrangement surface and the printing section face to each other. For example, when they face to each other in the upper and lower, the direction is a vertical direction (lifting direction), and when they face to each other in the front and back, the direction is a front-back direction.

In this case, it is preferable that the first adjustment section includes a worm that is provided in the support section and is engaged to the input section, a first cam that is provided in the support section and is axially connected to the interlock section, and a first cam follower that is rotatably contacted to the first cam.

In this configuration, the rotative power from the support section is adequately reduced and can be transmitted to the first cam by the worm, and also, the first cam follower can perform micro movement. Because of this, the first adjustment section can be configured in compact, and a gap can be adjusted accurately. By the way, when the span of the adjustable range in the gap adjustment is large, it is not necessary that the displacement (moving distance) of the cam curve of the first cam is required to be a linear with respect to the rotation so that it is preferable to make an appropriate adjustment by the cam curve.

Further, it is preferable that the interlock section includes a shaft that is axially connected to the first cam in one end, and wherein the second adjustment section includes a second cam provided in the support section to which another end of the shaft is axially connected, and a second cam follower that is rotatably contacted to the second cam.

In this configuration, in the same manner as the above description, the rotation power that was reduced can be transmitted to the second cam through the shaft, and also, the second cam follower can perform micro movement by the second cam. Because of this, the second adjustment section can be configured in compact, and a gap can be accurately adjusted.

In this case, it is preferable that the first cam and the second cam are configured by an eccentric cam, respectively.

In this configuration, the first cam and the second cam can be easily formed (manufactured). Also, a cam surface (cam curve) of the eccentric cam is a circular form so that the displacement with respect to the rotation in the arc part near the axis and in the arc part far from the axis becomes fine, and the displacement with respect to the rotation in the middle of the arc part becomes rough. On the other hand, recording mediums have plural types in different thickness. Accordingly, it is preferable to determine which part of the arc part is used by taking the plural types of recording mediums in different thickness into consideration. By the way, to interlock the first cam and the second cam accurately, it is preferable that the first cam and the second cam are manufactured by producing its cam surface and its shaft hole at the same time. Also, it is preferable that the shaft is manufactured by producing its both end parts and its axial attachment part at the same time.

Further, it is preferable that the input section has an operating handle for manual operation connected to the worm, and a lock mechanism that locks the operating handle in any rotation position.

In this configuration, after the gap adjustment, the operating handle is locked by the lock mechanism so that it is effectively prevented from deviation of the gap due to the vibration, and the like. By the way, it is preferable that the lock mechanism has a configuration to clamp a shaft of the operating handle and release clamping.

On the other hand, a gap measurement section that measures a dimension of a gap is also provided. It is preferable that in the support section, the gap measurement section includes a dial gauge, in which a measuring element is provided in a contact direction of the separate direction, and a contact piece that is provided in the first adjustment section and contacts to the measuring element of the dial gauge.

In this configuration, the dial gauge attached to the support section is attached in the contact direction of the separate direction so that a spindle (measuring element) of the dial gauge contracts when the gap becomes larger, and expands when the gap becomes smaller. Therefore, the measurement value of the dial gauge becomes a form of use to display a dimension of a direct gap so that the gap adjustment can be performed without any mistake.

BRIEF DESCRIPTION OF THE DRAWINGS

Referring now to the attached drawings which form a part of this original disclosure.

DETAILED DESCRIPTION OF EXEMPLARY EMBODIMENTS

Herein after, an inkjet recording apparatus according to one embodiment of the invention will be described in reference to the attached drawings. This inkjet recording apparatus prints (textile printing) a pattern, and the like on a fabric (original fabric) that removes the supplied material in so-called reel-to-reel format by using dye ink exclusively in the inkjet method. By the way, in the description below, it is defined that a forward and reverse feed direction of a recording medium, which is a fabric, is the direction of the X axis. Also, it is defined that a direction intersecting the direction of the X axis is the direction of the Y axis. Further, it is defined that a direction intersecting the direction of the X axis and the direction of the Y axis is the direction of the Z axis.

Figure 1:
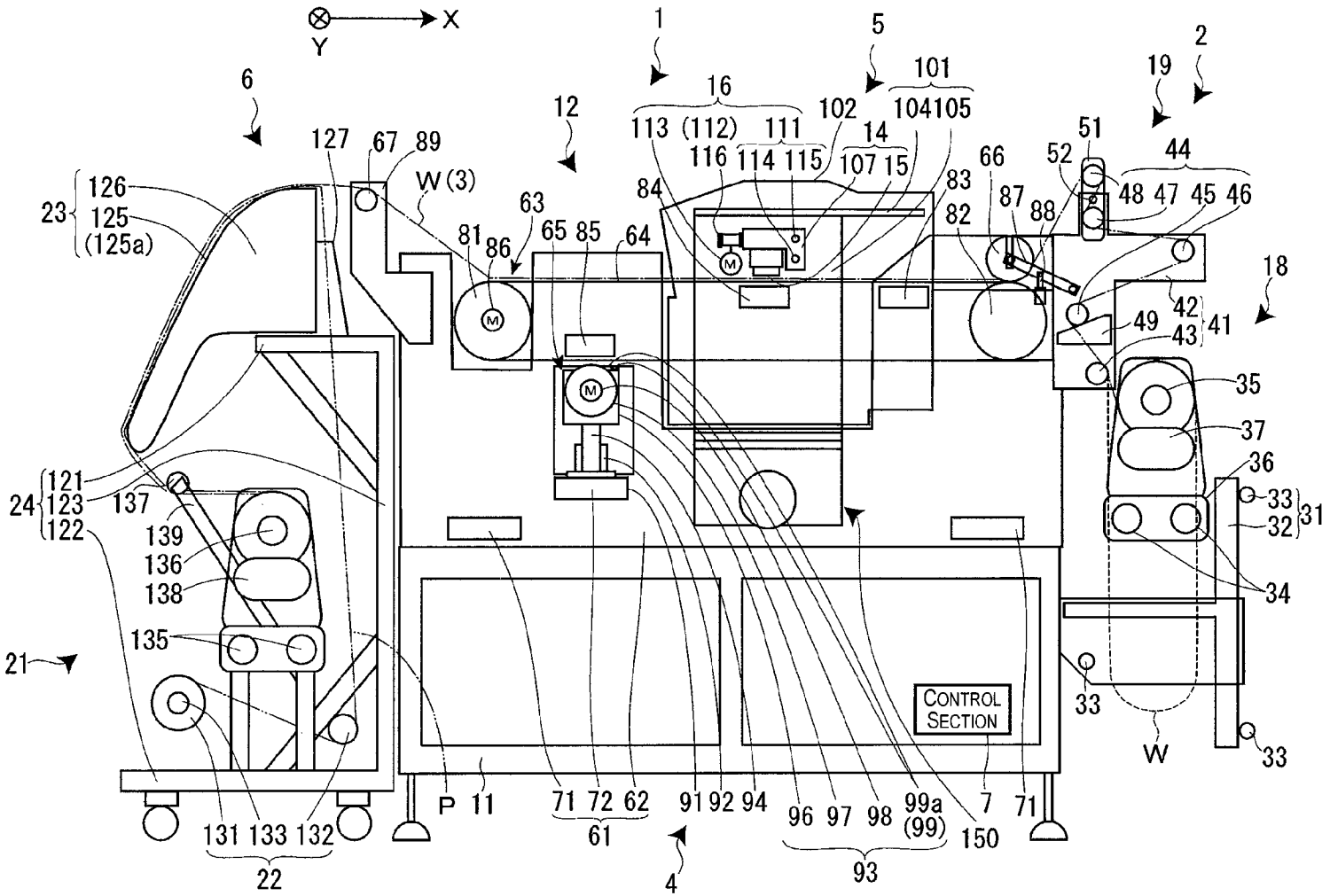
FIG. 1 is a cross-section structural diagram schematically showing an inkjet recording apparatus according to an embodiment.

FIG. 1 is a cross-section structural diagram of an inkjet recording apparatus. As shown in the drawing, the inkjet recording apparatus 1 is provided with a feed section 2 that feeds and sends a recording medium W, which is rolled in a roll shape, an apparatus main body 4 that sends the fed recoding medium W along a feed route 3 for printing, a printing section 5 that is placed upper side of the apparatus main body 4 and performs printing to the recording medium W by the inkjet method in cooperation with the apparatus main body 4, a winding section 6 that takes up and collects the recording medium W printed by the printing section 5 in the downstream side of the feed direction of the apparatus main body 4, and a control section 7 that totally controls these components.

The apparatus main body 4 is provided with a machine stand for main body 11 that is configured by combining steel materials, a medium feed mechanism 12 that is supported by the machine stand for main body 11 and intermittently feeds the recording medium W by a belt conveyance in the direction of the X axis. The printing section 5 is provided with a carriage unit 14 that has an inkjet head 15, and a head moving mechanism 16 that reciprocates the carriage unit 14 in the direction of the X axis. On the other hand, the feed section 2 is provided with a feed unit 18 that feeds the recording medium W, and a slack removing unit 19 that removes slack of the fed recording medium W. Also, the winding section 6 is provided with a winding unit 21 that winds the recording medium W, an interleaf unit 22 that supplies an interleaf P to the winding unit 21, and a heater unit 23 that vaporizes solvent (fluid) of dye ink soaked in the recording medium W before winding the recording medium W, and it has a configuration that these components are mounted on a machine stand for winding section 24.

A slack of the recording medium W (fabric) fed from the feed unit 18 is removed so as to be stretched by the slack removing unit 19 and the recording medium W is fed to the medium feed mechanism 12. The recording medium W fed to the medium feed mechanism 12 is adhered to a surface and conveyed by the belt. In this belt conveyance, the recording medium W is intermittently fed in the direction of the X axis (sub-scanning). On the other hand, synchronizing with this, the carriage unit 14 reciprocates in the direction of the Y axis and the ink is discharged from the inkjet head 15 (main scanning).

After a printing was performed in this way, a part of the recording medium W where the printing has already been done (printed part) is fed to the winding section 6 from the medium feed mechanism 12. In the winding section 6, an interleaf P is continuously supplied from the interleaf unit 22 to the recording medium W fed from the medium feed mechanism 12 so that the recording medium W and the interleaf P are overlapped and they are fed to the heater unit 23. In the heater unit 23, the recording medium W is heated with the interleaf P and the solvent (fluid) of the dye ink is vaporized. Because of this, the printed recording medium W that was dried is wound in the winding unit 21 with the interleaf P.

As shown in FIG. 1, the feed unit 18 is provided with a feed frame 31 that consists of a pair of T-shaped frames 32, which are arranged on the left and right (direction of the Y axis), fixed in the above described machine stand for main body 11 and a plurality of rod-shaped frames 33 across between the pair of T-shaped frames 32, two feed-side rod bases 34 that extend in the direction of the Y axis and support the pair of T-shaped frames 32 in both ends, and a pair of feed shaft protrusions 35 that is slidably supported by the two feed-side rod bases 34. A tip of the respective feed shaft protrusions 35 forms a truncated cone shape. The pair of feed shaft protrusions 35 horizontally supports the recording medium W by bringing them near each other in the width corresponding to the width of the recording medium W and fitting the respective tips to the core of the roll-shaped recording medium W.

In the pair of feed shaft protrusions 35, a width movement unit 36 driven by a motor is respectively provided. When a winding slippage in the axial direction is caused in the recording medium W (detection), the pair of feed shaft protrusions 35 performs micro movement on the two feed-side rod bases 34 so that it is prevented from a position misalignment in the width direction with respect to the medium feed mechanism 12 of the recording medium W. That is, it is prevented from meandering (skew) the recording medium W in the medium feed mechanism 12.

Also, in one of the pair of feed shaft protrusions 35, a rotation unit 37 driven by a motor is provided. By the rotation unit 37, the recording medium W is fed by rotating the pair of feed shaft protrusions 35. In the present embodiment, there are a tension mode that feeds the recording medium W with a certain tension and a loosening mode that feeds the recording medium W by reducing tension as much as possible so that a mode switch is performed depending on a different recording medium W.

In the tension mode, this is used for a normal fabric (recording medium W) having a low elongation and contraction property, and in this case, in the control system of the rotation unit 37, the control section 7 controls the rotation unit 37 to take a load (tension) so that the load becomes a predetermined value. On the other hand, in the loosening mode, this is used for a fabric (recording medium W) having a high elongation and contraction property such as, for example, stocking material. In this case, the fed recording medium W is once loosened on the lower side (indicating in a broken line in FIG. 1), and it controls the recording medium W is sent to the slack removing unit 19. Specifically, a lower part of the loosened recording medium W is detected so that when the loosening of the lower part is largely crossed over a predetermined position, the feed operation of the recording medium W by the rotation unit 37 is stopped.

The slack removing unit 19 is provided with a slack removing frame 41 that consists of a pair of L-shaped frames 42, which are arranged on the left and right (direction of the Y axis), fixed in a side frame 62 of the medium feed mechanism 12, which will be described later, and a rod frame 43 across between the pair of L-shaped frames 42, and a roller group 44 that is rotatably supported by the pair of L-shaped frames 42 in the both ends. The roller group 44 is provided with the first roller 45, the second roller 46, the third roller 47, and the fourth roller 48 in the order from the upstream side in the feed direction so that the feed route 3 of the recording medium W fed from the feed unit 18 is bent at a plurality of locations.

The first roller 45 is configured by a roller having high coefficient of friction, and the both ends of the first roller are mounted on a pair of inclined blocks 49 that is attached on the inner side of the respective L-shaped frames 42. In the state that the upstream side of the recording medium W has got loose, the route is changed diagonally outward toward the second roller 46 at the section of the first roller 45. The recording medium is pulled (fed) by the intermittent feed of the medium feed mechanism 12, and the first roller 45 moves as to climb the pair of inclined blocks 49 by the friction force between the recording medium W and the first roller 45. Also, when feeding the recording medium W stops, the first roller 45 goes down the pair of inclined blocks 49 by its own weight so as to return to the original position. Because of this, an appropriate tension is given to the recording medium W that is going to be fed, and a shock of the intermittent feed is absorbed.

The recording medium W that passes the first roller 45 makes a U-turn at the second roller 46 and reaches to the third roller 47 and the fourth roller 48. The third roller 47 and the fourth roller 48 are vertically provided in the vicinity to each other, and are rotatably supported by the pair of bearings 51 in which the both ends integrally formed. Also, the respective bearings 51 are rotatably supported by the L-shaped frames 42, and in one of the bearings 51, an angle adjustment unit 52 that adjusts a set angle of the third roller 47 and the fourth roller 48 in vertical is provided.

A route for the recording medium W that passes the third roller 47 and the fourth roller 48 is changed to the "S" shape, but the "S" shape is adjustably changed in response to the type of the recording medium W so that an appropriate tension can be given depending on a different type of the recording medium W. Because of this, a slack or a crinkle portion is removed and the recording medium W is fed to the medium feed mechanism 12. By the way, it is preferable that these rollers 45, 46, 47, 48 have a convex shape so that a component force is functioned to the recording medium W outward from the center thereof.

As shown in FIG. 1, the medium feed mechanism 12 is provided with a main body frame 61 that has the pair of side frames 62, which are arranged on the left and right (direction of the Y axis), mounted and fixed on the above described machine stand for main body 11, a belt conveyance unit 63 that is supported by the pair of side frames 62 and has an endless conveyance belt 64, and a belt washing unit 65 that is provided in the lower side of the belt conveyance unit 63. Also, the medium feed mechanism 12 is provided with a pressing roller 66 that engages to the belt conveyance unit 63 from upper side in the upstream side, and a separating roller 67 that is provided diagonally upward with respect to the belt conveyance unit 63 in the downstream side.

The main body frame 61 is provided with the pair of side frames 62 that is configured by a thick board, and a pair of coupling frames 71 that are arranged the front and back (direction of the X axis) and couples the pair of side frames 62 so that it is mounted and fixed on the machine stand for main body 11 by the pair of side frames 62. Also, the pair of the coupling frames 71 is sandwiched in between the pair of side frames 62 so that they are coupled, and the main body frame 61 has a support frame 72 to support the above described belt washing unit 65. In the respective side frames 62, a notch for mounting the belt conveyance unit 63 and a notch for mounting the printing section 5 are arbitrarily provided, and an opening section is formed to check the belt washing unit 65.

The belt conveyance unit 63 is provided with a drive pulley 81 that is located in the downstream side of the feed direction, a driven pulley 82 that is located in the upstream side of the feed direction, and an endless conveyance belt 64 that bridges between the drive pulley 81 and the driven pulley 82. Also, the belt conveyance unit 63 is provided with a first guide plate 83 that is located near the driven pulley 82 and guides to drive the conveyance belt 64, a second guide plate 84 that is located directly below the printing section 5 and guides to drive the conveyance belt 64, and a third guide plate 85 that is located directly below the above described support frame 72 and guides to drive the conveyance belt 64, which traveled around the back side.

In the state that the mutual surfaces of the first guide plate 83 and the second guide plate 84 are arranged so as to become a flush surface (the same horizontal surface), the pair of side frames 62 are bridged so that it is functioned as a part of the main body frame 61. Also, the first guide plate 83 guides the conveyance belt 64 (of the upper side) immediately after leaving from the driven pulley 82 so that it is driven horizontally, and the second guide plate 84 guides the conveyance belt 64 (of the upper side) located in a print area without any slack. Therefore, the conveyance belt 64 located directly above the second guide plate 84 functions as a platen. In addition, the third guide plate 85 guides the conveyance belt 64 so as to press the push-up power received from the belt washing unit 65 (the detail will be described later).

The drive pulley 81 and the driven pulley 82 are rotatably supported by the pair of side frames 62 through the dedicated bearing, and one axial end of the drive pulley 81 couples to a conveyance motor 86 to intermittently drive the conveyance belt 64. The conveyance belt 64 is configured by a wide special belt that has adhesiveness (adhesion process) on the outer periphery (surface) so that the recording medium W is stuck and fed in the direction of the X axis. Because of this, in directly below the printing section 5, the recording medium W is fed for a printing (intermittent feed) without causing burr, and the like.

In the upper side of the driven pulley 82, the pressing roller 66 that sticks the recording medium W, which was fed from the slack removing unit 19, to the conveyance belt 64 is provided. The pressing roller 66 is rotatably supported by a tip part of a pair of support arms 87 that are rotatably supported by the side frames 62. Also, the pressing roller 66 has a predetermined elasticity and own weight, and by its own weight, it presses the recording medium W to the conveyance belt 64 in directly above the driven pulley 82. That is, the pressing roller 66 and the driven pulley 82 sandwiches the conveyance belt 64 and functions as a nip roller so that the recording medium W is continuously stuck on the conveyance belt 64 that is driven. By the way, in the intermediate position of the respective support arms 87, an air cylinder 88 is coupled for rotating the support arms 87, and the pair of air cylinders 88 is synchronously driven so that the pressing roller 66 is separated from the conveyance belt 64.

On the other hand, in a position diagonally upward the drive pulley 81, the separating roller 67 feeding to the winding section 6 is provided to separate the recording medium W from the conveyance belt 64 after the printing. The separating roller 67 is rotatably supported by a pair of sub-frames 89 extending from the side frames 62. In this case, the separating roller 67 relatively separates the recording medium W from the conveyance belt 64 that circles around and goes around to the back side of the drive pulley 81, but in an actual operation, a separation power from the conveyance belt 64 is different depending on a type of the recording medium W. Because of this, depending on a type of the recording medium W, there is a case that the separation starts in a position where the conveyance belt 64 starts the round, or there is a case that the separation starts in a position where the round has progressed to certain extent. However, when a point of the separation goes round on the back side, it is likely to get the recording medium W caught in the conveyance belt 64.

Accordingly, in the present embodiment, an angle of the recording medium W fed from the conveyance belt 64 to the separating roller 67 is detected, and the winding unit 21 is driven to wind based on the detection result of the position detection so that it prevents a point of the separation from going round on the back side of the conveyance belt 64.

As shown in FIG. 1, the belt washing unit 65 is supported by the above described support frame 72 in the lower side of the conveyance belt 64, and extends in the direction of the Y axis as to cross the conveyance belt 64. The belt washing unit 65 is provided with a unit base 91 that is mounted on the support frame 72, a lifting cylinder 92 that is provided so as to stand in the unit base 91, a washing unit main body 93 that is lifted by the lifting cylinder 92, and a pair of lifting guides 94 that guides to move up and down the washing unit main body 93.

Further, the washing unit main body 93 is provided with a boxlike washing container 96 that extends in the direction of the Y axis and reserves wash solution, a rotating brush 97 that is stored in the washing container 96, a washing motor 98 that rotates the rotating brush 97, and a wiper 99 that relatively wipes out the wash solution sticking on the conveyance belt 64. The wiper 99 is disposed inside of the wash container 96, and is configured by two wiping blades 99*a* provided in "V" shape, and contacts to the conveyance belt 64 that is driven so as to wipe out the wash solution. By the way, ultimately remaining wash solution on the conveyance belt 64 is wiped out by a waste cloth. Also, it is preferable that the wash solution is circulated while filtering in between the external tank.

In the conveyance belt 64 having adhesiveness, lint or dust is adhered depending on time so that the washing to the conveyance belt 64 by the belt washing unit 65 is performed periodically. In the washing operation, after lifting the washing unit main body 93 to the position where the rotating brush 97 and the wiper 99 contact to the conveyance belt 64, the conveyance belt 64 is driven and the rotating brush 97 is rotated in the direction opposite to the driving direction of the conveyance belt. In this time, the conveyance belt 64 is pressed by the above described third guide plate 85, and contacts with the rotating brush 97 while maintaining the horizontal-position. Because of this, the conveyance belt 64 (of adhesive surface) is continuously washed by brushing. By the way, after the washing, it is preferable to perform an adhesion process to recover the adhesion of the conveyance belt 64.

As shown in FIG. 1, the printing section 5 is provided with a printer frame 101 that extends in the direction of the Y axis to stride over the feed route 3 (belt conveyance unit 63), a head moving mechanism 16 that is supported by the printer frame 101, a carriage unit 14 that reciprocates the head moving mechanism 16 in the direction of the Y axis, and a printer cover 102 that covers these components. Also, it is not specifically drawn, but in the printing section 5, a cap unit and a cleaning unit that maintain the inkjet head 15 are provided. By the way, so-called paper gap (workpiece gap) in the printing section 5 has a range of thickness in various recording mediums W so that it is adjusted by lifting entire printing section 5 with respect to the apparatus main body 4 (medium feed mechanism 12).

As shown in FIG. 1, the printer frame 101 is provided with a beam-shaped frame 104 made of the sheet metal that extends in the direction of the Y axis and a pair of stand frames 105 made of the sheet metal that supports the beam-shaped frame 104 in the both ends. In the pair of stand frames 105, the above described side frames 62 are supported. By the way, the printer cover 102 is mounted on this printer frame 101.

A carriage unit 14 is provided with the inkjet head 15 that has plural colors of nozzle lines for color print and a carriage 107 that holds the inkjet head 15 in which the nozzle surface is facing down. By the way, each color of dye inks supplied to each nozzle line is supplied from so-called off-carriage ink tank.

The head moving mechanism 16 is provided with a carriage guide 111 that slidably supports the carriage unit 14 in a cantilever in the direction of the Y axis, a belt conduction mechanism 112 that reciprocates the carriage guide 111, and a carriage motor 113 that drives the belt conduction mechanism 112. The carriage guide 111 is composed of a main guide 114 in a lower side and a sub-guide 115 in an upper side. The main guide 114 and the sub-guide 115 support the above described pair of stand frame 105 in its both ends. The belt conduction mechanism 112 is provided with a timing belt 116, and a part of the timing belts 116 is fixed to the carriage unit 14 (carriage 107).

When the timing belt 116 is reciprocally driven by a carriage unit 14, the carriage guide 111 is guided to reciprocate in the direction of the Y axis. A moving position of the carriage guide 111 is detected by a linear encoder, and each color of the dye inks is selectively discharged from the inkjet head 15 based on the detection result and the print data. Because of this, the printing (textile printing) to the recording medium W is performed.

As shown in FIG. 1, the winding section 6 is provided with the machine stand for winding section 24 that detachably couples to the machine stand for main body 11 in the direction of the X axis, the heater unit 23 that is supported by the upper part of the machine stand for winding section 24, the winding unit 21, and the interleaf unit 22 that are supported by the lower part of the machine stand for winding section 24. For the printed recording medium W, there is a method for directly winding a thick recording medium W, which does not get ink offset, and there is a method for winding a thin recording medium W, which easily gets ink offset, overlapped with an interleaf P. It has a design available to any method. The case that the latter method is employed will be described below.

The machine stand for winding section 24 is provided with an upper horizontal frame section 121, a lower horizontal frame section 122, and a vertical frame section 123 that couples the upper horizontal frame section 121 and the lower horizontal frame section 122. They are configured by lengthwise and breadthwise combining the extruded shape materials of aluminum. And, the vertical frame section 123 is detachably coupled to the machine stand for main body 11.

The heater unit 23 is provided with a heat release plate 125 that has an arc-like heat release surface 125*a*, and a heater 126 that is attached inside in the heat release plate. Also, in the state that the upper half section of the heater unit 23 is mounted on the upper horizontal frame section 121, the heater unit 23 is fixed to the upper horizontal frame section 121 by left and right fixing members 127 provided in the upper horizontal frame section 121. The top end of the heat release plate 125 is provided in a position that is adjacent to the above described separating roller 67 and is slightly lower than the separating roller 67. Also, the top end of the heat release plate 125 is bent in an arc shape, which is facing down, to change a route for an interleaf P introduced from the lower side of this section.

The recording medium W that passed the separating roller 67 overlaps with the interleaf P fed from the lower side in the top end of the heat release plate 125 and is fed to the lower side along the arc-shaped outer surface (heat release surface 125*a*) of the heat release plate 125. The recording medium W and the interleaf P that are vertically fed by slidably contacting to the heat release surface 125*a* are continuously heated by the heater 126. By this heat, the solvent (fluid) of the dye ink soaked in the recording medium W is vapored so that the dye is fixed to the fabric.

The interleaf unit 22 is provided with an interleaf roller 131 that feeds a roll-shaped interleaf P, and a guide bar 132 that changes a route of the fed interleaf P toward the top end of the heat release plate 125. The guide bar 132 is fixed in a part of a diagonal member that couples between the lower horizontal frame section 122 and the vertical frame section 123. Also, the interleaf roller 131 is supported in the front part of the lower horizontal frame section 122 through the pair of bearing units 133 that is provided with a damping mechanism. The interleaf P is fed without causing any slack by the pair of bearing units 133.

The winding unit 21 is supported by the rear section of the lower horizontal frame section 122 in the same manner as the above described feed unit 18. The winding unit 21 is provided with two winding side rod bases 135 that extend in the direction of the Y axis, and a pair of winding shaft projections 136 that is slidably supported by the two winding side rod bases 135. Also, the winding unit 21 is located in the feed route 3 between the bottom end of the heat release plate 125 and the pair of winding shaft projections 136, and has a tension roller 137 that gives a tension to the recording medium W and the interleaf P.

The top end of the respective winding shaft projections 136 is formed in a truncated cone shape, and the respective top ends of the pair of winding shaft projections 136 are engaged to the winding core winding the recording medium W by mutually aligning the width of the recording medium W so that it is horizontally maintained. One side of the pair of winding shaft projections 136 provides a rotation unit 138 driven by a motor so that the pair of winding shaft projections 136 is rotated and the recoding medium W and the interleaf P are simultaneously wound. Further, in the position adjacent to the separating roller 67 as described above, the rotation unit 138 is controlled based on the angle detection of the recording medium W fed to the separating roller 67.

A tension roller 137 is rotatably supported by the end part of a pair of turn arms 139 that is rotatably supported in the rear part of the lower horizontal frame section 122. And, the tension roller 137 rotationally contacts to the interleaf P side of the recording medium W, which is wound in the winding core, and the interleaf P. The recording medium W and the interleaf P are biased so as to turn to the lower side by the own weight of the tension roller. Because of this, an appropriate tension is given to the recording medium W and the interleaf P, and the recording medium W and the interleaf P are wound in the winding core.

Next, a gap adjustment section 150 that adjusts so-called paper gap of the inkjet head 15 will be described in reference to FIG. 2 and FIG. 4. As described above, a paper gap (workpiece gap) in the printing section 5 is adjusted by lifting entire printing section 5 with respect to the apparatus main body 4 (medium feed mechanism 12). Also, for the recording medium W, an extreme thick recording medium (8 mm in the maximum thickness) is assumed. For this reason, the left part (front side in FIG. 1) and the right part (back side in FIG. 1) of the gap adjustment section 150 are simultaneously lifted (parallel shift) in respect to the printing section 5 that is provided to stride over the feed route 3 (belt conveyance unit 63). By the way, the phrase "arrangement section" called in the claims is configured by the conveyance belt 64 (belt conveyance unit 63), and the word "arrangement surface" is configured by the surface of the conveyance belt 64. Also, the phrase "separate direction" called in the claims is the direction of lifting the printing section 5.

Figure 2:
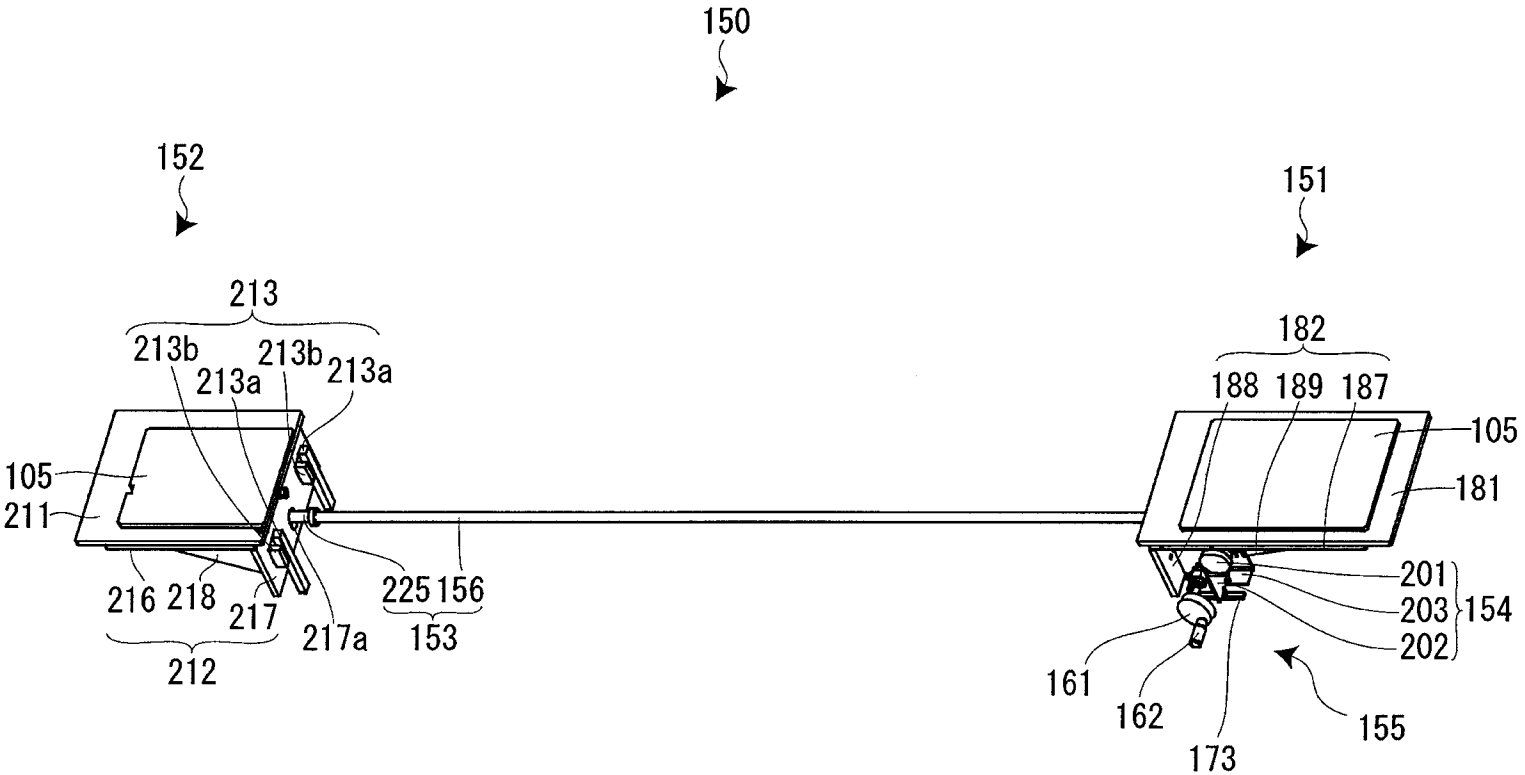
FIG. 2 is a perspective view of a gap adjustment section as a whole.

As shown in FIG. 2, the gap adjustment section 150 is provided with a left adjustment section 151 (the first adjustment section) that lifts one end part (left part) of the printing section 5, a right adjustment section 152 (the second adjustment section) that lifts the other end part (right part) of the printing section 5, an interlock section 153 that has a connecting shaft 156 to interlock the adjustment operation of the left adjustment section 151 and the right adjustment section 152, and a gap measurement section 154 that measures and displays a gap dimension according to the gap adjustment. Also, the gap adjustment section 150 is provided with the interlock section 153 so that it is provided with a manual operation input section 155 to adjust one of the left adjustment section 151 and the right adjustment section 152 (it is the left adjustment section 151 in the embodiment). By the way, the gap measurement section 154 is also provided in the left adjustment section 151 side.

Figure 3:
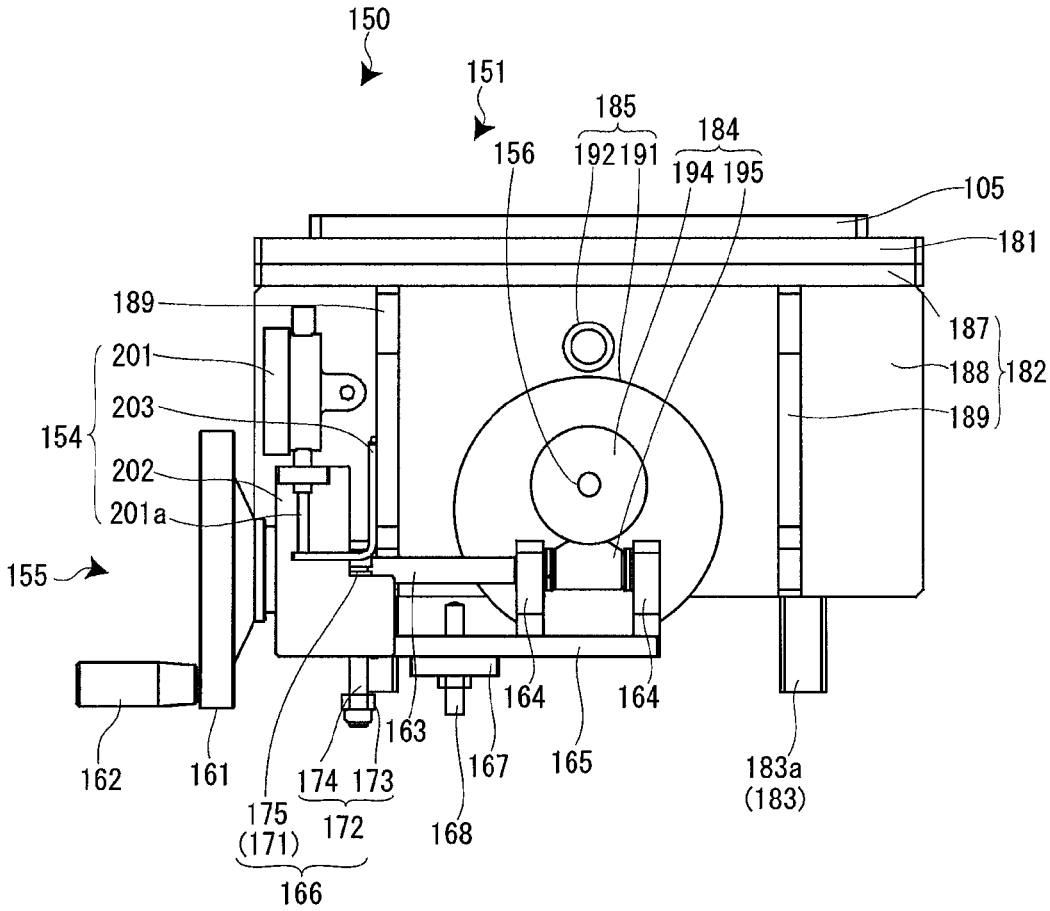
FIG. 3 is a front view of a left adjustment section of the gap adjustment section.

As shown in FIG. 2 and FIG. 3, the input section 155 is provided with a wheel-shaped operating handle 161 that has a grip 162, a handle shaft 163 that mounts to the operating handle 161, two radial bearings 164 that rotatably supports the handle shaft 163, a handle base 165 that supports the operating handle 161 through the two radial bearings 164 and the handle shaft 163, and a lock mechanism 166 that locks and unlocks the rotation of the handle shaft 163. And, in the handle shaft 163, a worm 195, which will be described later, is mounted and is located between the two radial bearings 164.

The operating handle 161 exposes to outside, and a paper gap is adjusted by forward and reverse rotation by the grip 162. By the way, the input section 155 in the embodiment is driven by manual, but it can be driven by a motor. The handle base 165 forms a rectangular shape along the handle shaft 163, and is supported by the above described side frames 62 (bottom end part of the left side of the side frames 62). Also, in the installing block 167, a stopper thread 168 screws together so as to penetrate the installing block. The bottom end of the perpendicular plate 188, which will be described later, contacts to the end (top end) of the stopper thread 168 so that a position in the lower movement of the gap adjustment is controlled. Because of this, even when the handle operation is performed in error, the nozzle surface of the inkjet head 15 does not contact to the surface of the conveyance belt 64.

The lock mechanism 166 locks and unlocks the rotation of the handle shaft 163 by clamping the handle shaft 163 and releasing the clamping of the handle shaft 163 so that it is provided with a mechanism main body 171 that is located adjacent to the operation handle 161 and is supported by the handle base 165, and a lock operating section 172 that operates to clamp the mechanism main body 171 and release the clamping of the mechanism main body 171. The lock operating section 172 is composed of a straight line-shaped operation rod 173 that exposes to the back side of the operating handle 161, and a step rod shaft 174 that mounts to the operation rod 173. A male thread (not shown) is formed in the top end of the rod shaft 174. On the other hand, the mechanism main body 171 is configured by a block forming a slitting 175 that wraps around the handle shaft 163 in the cross-section direction. A female thread that screws together with the male thread of the rod shaft 174 is provided in the upper side of the slitting 175 (not shown), and a loose hole is formed in the lower side of the slitting 175 (not shown).

When the operation rod 173 is rotated forward and screws the rod shaft 174, the upper portion of the slitting 175 in the mechanism main body 171 is pulled to the handle base 165 and the handle shaft 163 is clamped (lock). By contraries, when the operation rod 173 is rotated in reverse and the rod shaft 174 is loosen up, the clamping of the handle shaft 163 is released (unlock). In a series of operation for the gap adjustment, first, the lock for the operating handle 161 is released, and the gap adjustment is performed by operating the operating handle 161 while an operator is looking at the gap measurement section 154 on a display. And, after the gap adjustment, it goes to a procedure to lock the operating handle 161. In this way of locking the operating handle 161, a paper gap that was set does not get out of tune caused by the vibration, and the like.

The left adjustment section 151 is provided with a left end portion of the printing section 5, that is, a left seating plate 181 on which a base of the left side of the above described stand frame 105 (one of legs) seats, a left bracket section 182 that supports the left seating plate 181 from the bottom side, a left lifting guide 183 that liftably guides the left bracket section 182, a worm-worm wheel 184 that couples to the input section 155, and a left cam mechanism 185 that transforms the rotation of the worm-worm wheel 184 to the lifting movement of the left bracket section 182.

The left bracket section 182 is configured by a horizontal plate 187 that supports the left seating plate 181, a perpendicular plate 188 that is perpendicularly formed bottom from one side of the end portion of the horizontal plate 187, and a pair of reinforcing plates 189 that is provided to medially separate the horizontal plate 187 and the perpendicular plate 188. Also, a long hole (not shown) in which the connecting shaft 156 of the above described interlock section 153 is loosely inserted is formed in the perpendicular plate 188.

The left lifting guide 183 is composed of a pair of slide guide **183*a* that is fixed on the outer surface of the left side of the above described side frame 62, and a pair of sliders (not shown) that engages to the slide guide 183*a*. The pair of sliders is fixed on the back surface of the perpendicular plate 188 of the left bracket section 182. Therefore, in the lower half part of the side frame 62, the left bracket section 182 is liftably configured in the state that it is protruded to the outside from the side frame 62. By the way, the phrase "one of the support sections", which is called in the claim, is configured by the left side of the side frames 62**.

The left cam mechanism 185 is configured by an eccentric cam 191 that is coaxially provided with a worm wheel 194 of the worm-worm wheel 184, and a cam follower 192 (roller follower) that is provided in the upper center of the perpendicular plate 188. The eccentric cam 191 and the worm wheel 194 are provided in the left end part of the above described connecting shaft 156, and they are rotatably supported by the side frames 62 through the connecting shaft 156. Also, the worm 195 is provided in the end of the above described handle shaft 163, and it is supported by the side frames 62 through the radial bearings 164, the handle base 165, and the installing block 167.

When the operating handle 161 is performed forward and reverse rotation, the rotation speed of the eccentric cam 191 is reduced through the worm-worm wheel 184 and the cam follower 192 that engages to the eccentric cam is lifted in accordance with a cam curve. Because of this, the left bracket section 182 in which the cam follower 192 is mounted is lifted with respect to the side frames 62.

The gap measurement section 154 is provided with a dial gauge 201 that is provided in the upper side of the operating handle 161, a gauge frame 202 that supports the dial gauge 201, and a "L"-shaped contact plate 203 (contact piece) to which a spindle 201*a* of the dial gauge 201 (measuring element) contacts. The gauge frame 202 is installed to the handle base 165, and is supported by the side frames 62 through the installing block 167. On the other hand, the contact plate 203 is installed to one of the reinforcing plates 189 of the left bracket section 182. The spindle 201*a* is contracted when the contact plate 203 is lifted through the left bracket section 182, and the spindle 201*a* is expanded when the contact plate 203 comes down so that a paper gap can be measured directly.

By the way, first, a zero-point adjustment is performed in the dial gauge 201 of the embodiment, and the zero-point is defined that the nozzle surface of the inkjet head 15 is located in a position of 2 mm to 3 mm (2.7 mm in the embodiment) from the surface of the conveyance belt 64. Therefore, when a lifting adjustment of the printing section 5 is performed for the thickness of the introduced recording member W, it can be adjusted including a predetermined paper gap. Alternatively, the zero-point can be defined as the surface of the conveyance belt 64 so that a paper gap is indirectly measured (in this case, it is so-called platen gap).

Figure 4:
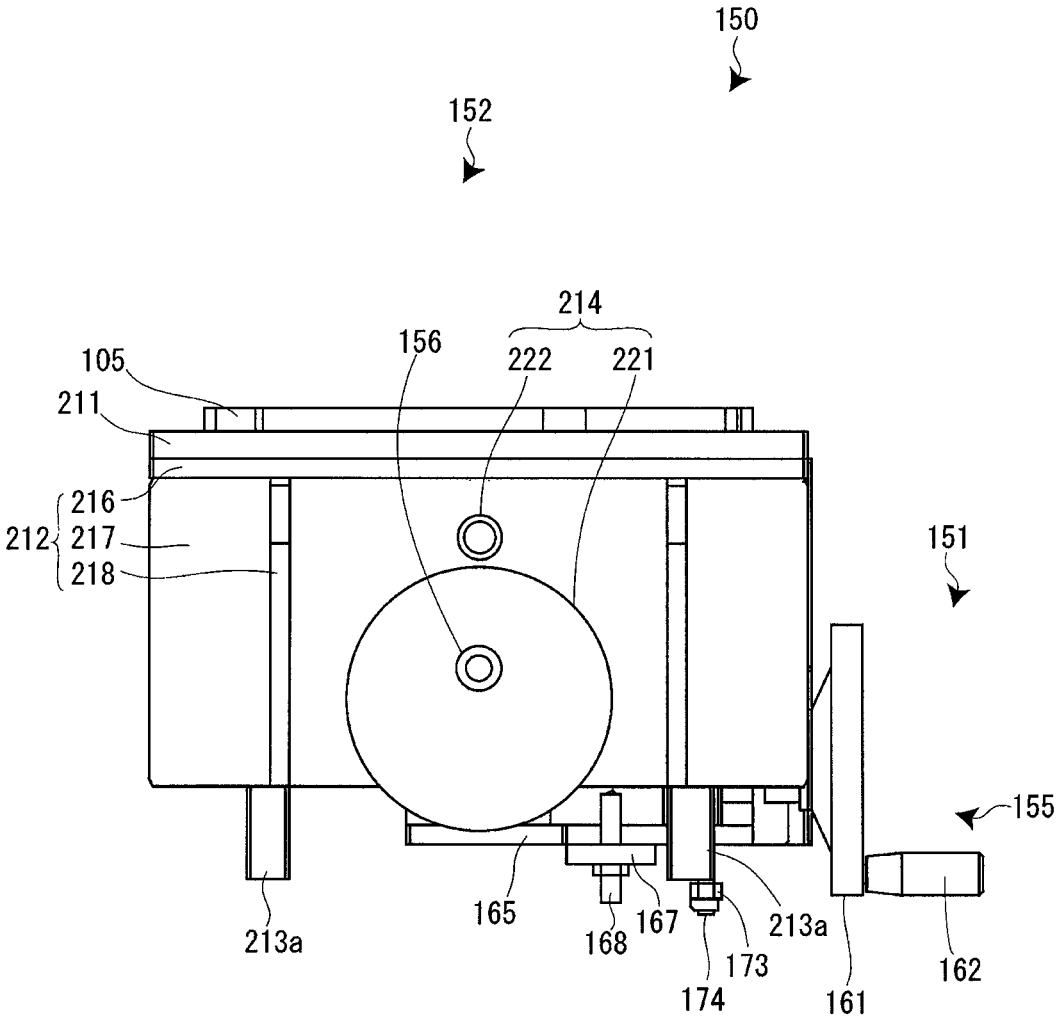
FIG. 4 is a front view of a right adjustment section of the gap adjustment section.

As shown in FIG. 2 and FIG. 4, the right adjustment section 152 has substantially the same embodiment as the left adjustment section 151 except a part of it. That is, the right adjustment section 152 is provided with a right end portion of the printing section 5, that is, a right seating plate 211 on which the base (the other leg) of the above described right side stand frame 105 is mounted, a right bracket section 212 that supports the right seating plate 211 from the bottom side, a right lifting guide 213 that liftably guides the right bracket section 212, and a right cam mechanism 214 that transforms the rotation of the connecting shaft 156, which will be described later, to the lifting movement of the right bracket section 212. By the way, the bases of the stand frames 105 in the left and right are different in size so that the left seating plate 181 and the right seating plate 211, and the left bracket section 182 and the right bracket section 212 are respectively different in size. On the other hand, it is used that the left can mechanism 185 and the right cam mechanism are totally the same.

The right bracket section 212 is configured by a horizontal plate 216 that supports the right seating plate 211, the perpendicular plate that is perpendicularly formed bottom from the horizontal plate 216, and a pair of reinforcing plates 218 that is provided to medially separate the horizontal plate 216 and the perpendicular plate 217 in the same manner as the left bracket section 182. Also, a long hole 217*a* in which the above described connecting shat 156 is loosely inserted is formed in the perpendicular plate 217.

In the same manner, the right lifting guide 213 is composed of a pair of slide guides 213*a* that is fixed in the outer surface of the right side of the above described side frames 62, and a pair of sliders 213*b* that engages to the slide guide 213*a*. The pair of sliders 213*b* is fixed to the back surface of the perpendicular plate 217 of the right bracket section 212. Therefore, in the lower half of the side frames 62, the right bracket section 212 is liftably configured in the state that it is protruded from the side frames 62 to the outside. The phrase "the other one of the support sections" called in the claim is configured by the right side of the side frames 62.

The right cam mechanism 214 is configured by an eccentric cam 221 that is coaxially provided with the connecting shaft 156, and a cam follower 222 (roller follower) that is provided in the upper center of the perpendicular plate 217. The eccentric cam 221 is provided in the right end portion of the connecting shaft 156 and is rotatably supported by the side frames 62 through the connecting shaft 156. When the connecting shaft 156 is rotated forward, the eccentric cam 221 rotates so that the cam follower 222 having the cam connection is lifted in accordance with the cam curve. Because of this, the right bracket section 212 on which the cam follower 222 is provided is lifted with respect to the side frames 62.

The interlock section 153 is provided with the connecting shaft 156 that connects between the eccentric cam 191 of the left adjustment section 151 and the eccentric cam 221 of the right adjustment section 152, and a pair of bearing units 225 that rotatably supports the connecting shaft 156 in both ends. The left side of the bearing unit 225 is fixed so as to penetrate the left side of the side frame 62, the right side of the bearing unit 225 is fixed so as to penetrate the right side of the side frame 62. That is, the connecting shaft 156 is rotatably supported in the left and right side frames 62 through the pair of bearing units 225. The left end portion of the connecting shaft 156 is a step shaft, and in this section, the eccentric cam 191 of the left adjustment section 151 and the worm wheel 194 are subjected to a key joint (axially connect) so as to become a rotation stopper. In the same manner, in the right end portion of the connecting shaft 156, the eccentric cam 221 of the right adjustment section 152 is subjected to a key joint (axially connect) so as to become a rotation stopper.

By the way, needless to say, the eccentric cam 191 of the left adjustment section 151 and the eccentric cam 221 of the right adjustment section 152 are totally the same thing (cam followers 192 and 222 in the same manner), and it is preferable to make it in the same processing apparatus including a key groove formed in a shaft hole. Also, it is in the same manner for the process of the both end portions of the connecting shaft 156.

In this manner, the left cam mechanism 185 and the right cam mechanism 214 are connected by the connecting shaft 156 in the gap adjustment section 150 of the present embodiment so that when the operating handle 161 is rotated forward, the left part and the right part of the printing section 5 can be simultaneously lifted in parallel shift. It is not necessary to control the left adjustment section 151 and the right adjustment section 152, separately. The operation for the gap adjustment can be simplified and the gap adjustment can be stabilized.

Further, in the pair of side frames 62 that supports the medium feed mechanism 12 (belt conveyance unit 63), the printing section 5 can be supported through the gap adjustment section 150 so that the surroundings of the main body frame 61 can be simple and compact configuration. In addition, the printing section 5 can be configured in lightweight compare to the medium feed mechanism 12 so that the configuration of the gap adjustment section 150 can be simplified by the left cam mechanism 185 and the right cam mechanism 214, and the gap adjustment can be performed with high accuracy by the simple operations. Therefore, the printing quality (textile printing quality) for the recording mediums with various different thicknesses can be improved.

By the way, the invention can be applied to so-called line printer or a type of a printer that moves the inkjet head 15 in the X and Y directions (main scanning direction and sub-scanning direction).

What is claimed is:

1. An inkjet recording apparatus comprising:

a printing section having an inkjet head and performing printing on a recording medium;

an apparatus main body having an arrangement section that includes a conveyance belt with an upper surface as an arrangement surface on which the recording medium is placed for conveying the recording medium in a conveyance direction and a lower surface opposed to the upper surface and movable in a direction opposite to the conveyance direction, and a support section that supports the printing section so as to stand the inkjet head face to face with the recording medium; and a gap adjustment section adjusting a gap between a nozzle surface of the inkjet head and the arrangement surface by moving the printing section in parallel with respect to the arrangement surface in a separate direction;

wherein the gap adjustment section has a first adjustment section and a second adjustment section that are placed across the arrangement section, an input section that operates the first adjustment section, and an interlock section that interlocks the first adjustment section and the second adjustment section, the first adjustment section including a first cam that is operatively coupled to the input section, and a first cam follower that is fixedly coupled to the support section, the first cam and the first cam follower slidably contacting with respect to each other at a location spaced from the inkjet head in the separate direction by more than distance between the inkjet head and the lower surface of the conveyance belt.

2. The inkjet recording apparatus according to claim 1, wherein the first adjustment section further includes a worm that is provided in the support section and is engaged to the input section, the first cam is provided in the support section and is axially connected to the interlock section, and the first cam follower is rotatably contacted to the first cam.

3. The inkjet recording apparatus according to claim 2, wherein the interlock section includes a shaft that is axially connected to the first cam in one end, and wherein the second adjustment section includes a second cam provided in the support section to which another end of the shaft is axially connected, and a second cam follower that is rotatably contacted to the second cam.

4. The inkjet recording apparatus according to claim 3, wherein the first cam and the second cam are respectively configured by an eccentric cam.

5. The inkjet recoding apparatus according to claim 2, wherein the input section includes an operating handle for manual operation connected to the worm, and a lock mechanism that locks the operating handle in any rotation position.

6. The inkjet recording apparatus according to claim 1, further comprising: a gap measurement section that measures a dimension of the gap;

wherein in the support section, the gap measurement section includes a dial gauge, in which a measuring element is provided in a contact direction of the separate direction, and a contact piece that is provided in the first adjustment section and contacts to the measuring element of the dial gauge.

7. The inkjet recording apparatus according to claim 1, further comprising a stopper arranged to restrict movement of the printing section with respect to the arrangement surface to prevent the nozzle surface of the inkjet head from contacting with the arrangement surface.

8. The inkjet recording apparatus according to claim 1, further comprising a slide guide arranged to guide movement of a part of one of the first and second adjustment sections in the separate direction.

* * * * *